US011550260B2

(12) United States Patent
Cattin et al.

(10) Patent No.: US 11,550,260 B2
(45) Date of Patent: Jan. 10, 2023

(54) HOROLOGICAL MOVEMENT WITH AUTOMATIC WINDING HAVING TIME-DISPLAYING HANDS LOCATED ON THE SAME SIDE AS THE ROTOR

(71) Applicant: ETA SA Manufacture Horlogere Suisse, Grenchen (CH)

(72) Inventors: Christophe Cattin, Le Noirmont (CH); Yassine Rachdi, Joncherey (FR); Laurent Kaelin, Sonvilier (CH); Dominique Boizard, Selzach (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 813 days.

(21) Appl. No.: 16/545,306

(22) Filed: Aug. 20, 2019

(65) Prior Publication Data

US 2020/0096942 A1 Mar. 26, 2020

(30) Foreign Application Priority Data

Sep. 24, 2018 (EP) ..... 18196380

(51) Int. Cl.
*G04B 5/14* (2006.01)
*G04B 5/18* (2006.01)

(52) U.S. Cl.
CPC ..... *G04B 5/14* (2013.01); *G04B 5/184* (2013.01)

(58) Field of Classification Search
CPC ..... G04B 5/18; G04B 5/184; G04B 5/14
See application file for complete search history.

(56) References Cited

U.S. PATENT DOCUMENTS 3,357,174 A * 12/1967 Guyot ..... G04B 13/007 368/208
6,485,172 B1 * 11/2002 Takahashi ..... G04B 5/14 368/208

(Continued)

FOREIGN PATENT DOCUMENTS

CH 703 964 A1 4/2012
CH 713302 A2 * 6/2018

(Continued)

OTHER PUBLICATIONS

Combined Chinese Office Action and Search Report dated Nov. 11, 2020 in corresponding Chinese Patent Application No. 201910902745.X (with English Translation of Category of Cited Documents) citing documents AO-AR therein, 7 pages.

(Continued)

*Primary Examiner* — Edwin A. Leon
*Assistant Examiner* — Jason M Collins
(74) *Attorney, Agent, or Firm* — Oblon, McClelland, Maier & Neustadt, L.L.P.

(57) ABSTRACT

A horological movement with automatic winding, including a plate, a barrel, a cannon-pinion including a minute pipe which supports a minute hand, an hour wheel set including an hour pipe which supports an hour hand, an oscillating weight, arranged on the same side of the plate as the cannon-pinion and the hour wheel set, which includes a central hub, a rim, a heavy sector, a lifting arbor rigidly connected to the central hub and about which the minute pipe and the hour pipe are mounted coaxially, the minute hand and the hour hand being located between the plate and the rim of the rotor.

12 Claims, 6 Drawing Sheets

(56) References Cited

U.S. PATENT DOCUMENTS

| | | | | |
|---|---|---|---|---|
| 7,837,381 | B2 * | 11/2010 | Damasko | G04B 5/08 368/208 |
| 9,557,712 | B2 * | 1/2017 | Rochat | G04B 5/165 |
| 2014/0153372 | A1 | 6/2014 | Kasapi et al. | |

FOREIGN PATENT DOCUMENTS

| | | | | |
|---|---|---|---|---|
| CN | 1503079 | A | 6/2004 | |
| CN | 1542571 | A | 11/2004 | |
| CN | 1658091 | A | 8/2005 | |
| CN | 204086820 | U | 1/2015 | |
| EP | 2 073 078 | A1 | 6/2009 | |
| EP | 2 551 731 | A1 | 1/2013 | |
| WO | WO-2006103560 | A2 * | 10/2006 | G04B 5/14 |

OTHER PUBLICATIONS

European Search Report dated Mar. 6, 2019 in European Application 18196380.2 filed on Sep. 24, 2018 (with English Translation of Categories of Cited Documents).

* cited by examiner

HOROLOGICAL MOVEMENT WITH AUTOMATIC WINDING HAVING TIME-DISPLAYING HANDS LOCATED ON THE SAME SIDE AS THE ROTOR

CROSS-REFERENCE TO RELATED APPLICATION

This application claims priority to European Patent Application No. 18196380.2 filed on Sep. 24, 2018, the entire disclosure of which is hereby incorporated herein by reference.

TECHNICAL FIELD

The invention relates to the horology field. More specifically, it relates to a horological movement with automatic winding intended to equip a wristwatch.

PRIOR ART

The first documented horological mechanisms with automatic winding date back to the end of the $18^{th}$ century. These mechanisms have undergone numerous enhancements. A typical mechanism widely used today comprises an oscillating weight in the form of a rotor, the rotation whereof is transmitted to the barrel via a reduction gear train.

Conventionally, a rotor comprises a hub, via which it is attached (with the possibility of rotation) to the plate of the movement, a rim (or "support") rigidly connected to the hub, and a heavy (or "weighty") annular sector rigidly connected to the rim and which, by the imbalance that it induces in the distribution of the weights of the rotor, causes the latter to rotate during the movements of the watch.

In numerous watches, the hands are located on the same side of the plate as a front face and conversely, the rotor is located on the same side of the plate as a rear face, i.e. the opposite side to the hands.

However, embodiments exist wherein the rotor is located on the same side as the hands, for example as disclosed in the Swiss patent CH 703 964. These embodiments, which are advantageous in terms of the distraction procured for the wearer by the display of the rotor's pivoting, however are not without drawbacks.

The horological movement proposed in the patent document CH 703 964 provides for the passage of the hour and minute pipes in a central opening made in the hub of the rotor, which is arranged between the body of the horological movement (including the plate, the bars and the wheel sets mounted such that they pivot between the plate and the bars) and the hour and minute hands.

This results in the hour and minute hands being located at a relatively large distance from the body of the movement, and in particular from a possible graduation for reading the hours.

This arrangement is problematic since, on the one hand, it is detrimental to the accurate reading of the time. On the other hand, the aesthetics are disputable as a result of the large space separating the hands and the body of the movement (given the fact that this space is at least partially occupied by the rotor).

One purpose of the invention is thus to overcome the aforementioned problems in a horological movement with automatic winding, the rotor whereof is located on the side on which the time is displayed.

SUMMARY OF THE INVENTION

In order to achieve the aforementioned purpose, the invention proposes a horological movement with automatic winding, which comprises:

- A plate;
- A barrel mounted such that it rotates relative to the plate and provided with a primary toothed wheel;
- A cannon-pinion mounted such that it rotates relative to the plate about a central axis and meshing with the primary toothed wheel of the barrel by way of a motion-work train, this cannon-pinion comprising a minute pipe which supports a minute hand;
- An hour wheel set mounted such that it rotates relative to the plate about the central axis and meshing with the cannon-pinion, this hour wheel set comprising an hour pipe which supports an hour hand;
- An oscillating weight in the form of a rotor mounted such that it rotates relative to the plate about the central axis, on the same side of the plate as the cannon-pinion and the hour wheel set, this rotor comprising:
  - A central hub that meshes with the barrel;
  - A rim rigidly connected to the central hub;
  - A heavy annular sector which is rigidly connected to the rim;
  - A lifting arbor rigidly connected to the central hub and via which the latter is mounted such that it rotates relative to the plate, the minute pipe and the hour pipe being mounted coaxially about the lifting arbor, the minute hand and the hour hand being located between the plate and the rim of the rotor.

According to one preferred embodiment, the movement comprises a bearing provided with a ring that is fixed relative to the plate, a ring that is capable of moving in rotation relative to the fixed ring about the central axis, and rolling elements inserted between the rings, the lifting arbor being rigidly connected to the mobile ring.

The mobile ring preferably supports a toothed transmission wheel that meshes with the barrel via a reduction gear train.

According to one embodiment, the fixed ring is an inner ring (preferably secured to the bar by a centre screw) of the bearing and the mobile ring is an outer ring.

The horological movement advantageously comprises a socket that is fixed relative to the plate and on which the hour pipe and the minute pipe are mounted. The hour pipe is slotted onto the socket and the minute pipe is slotted onto the hour pipe.

The cannon-pinion and the hour wheel set are advantageously mounted on an upper bar attached to the plate, this upper bar having an internal face on the plate side, and an opposite external face. The barrel is preferably mounted on the internal face side of the upper bar, whereas the cannon-pinion, the hour wheel set and the rotor are mounted on the external face side of the upper bar.

The horological movement preferably comprises:

- A motion-work train meshing with a minute-pinion rigidly connected to the minute pipe, which motion-work train is mounted such that it rotates relative to the upper bar on the external face side thereof;
- A reverser wheel set, which comprises:
  - An upper wheel located on the external face side of the upper bar and meshing with the motion-work train,
  - A lower wheel located on the internal face side of the upper bar, rigidly connected to the upper wheel for rotation therewith and meshing with the primary toothed wheel of the barrel;

A shaft connecting, through the upper bar, the upper wheel to the lower wheel.

BRIEF DESCRIPTION OF THE FIGURES

Other purposes and advantages of the invention will appear upon reading the description of one embodiment, which is given hereinbelow with reference to the accompanying figures, in which.

DETAILED DESCRIPTION OF THE INVENTION

Figure 1:
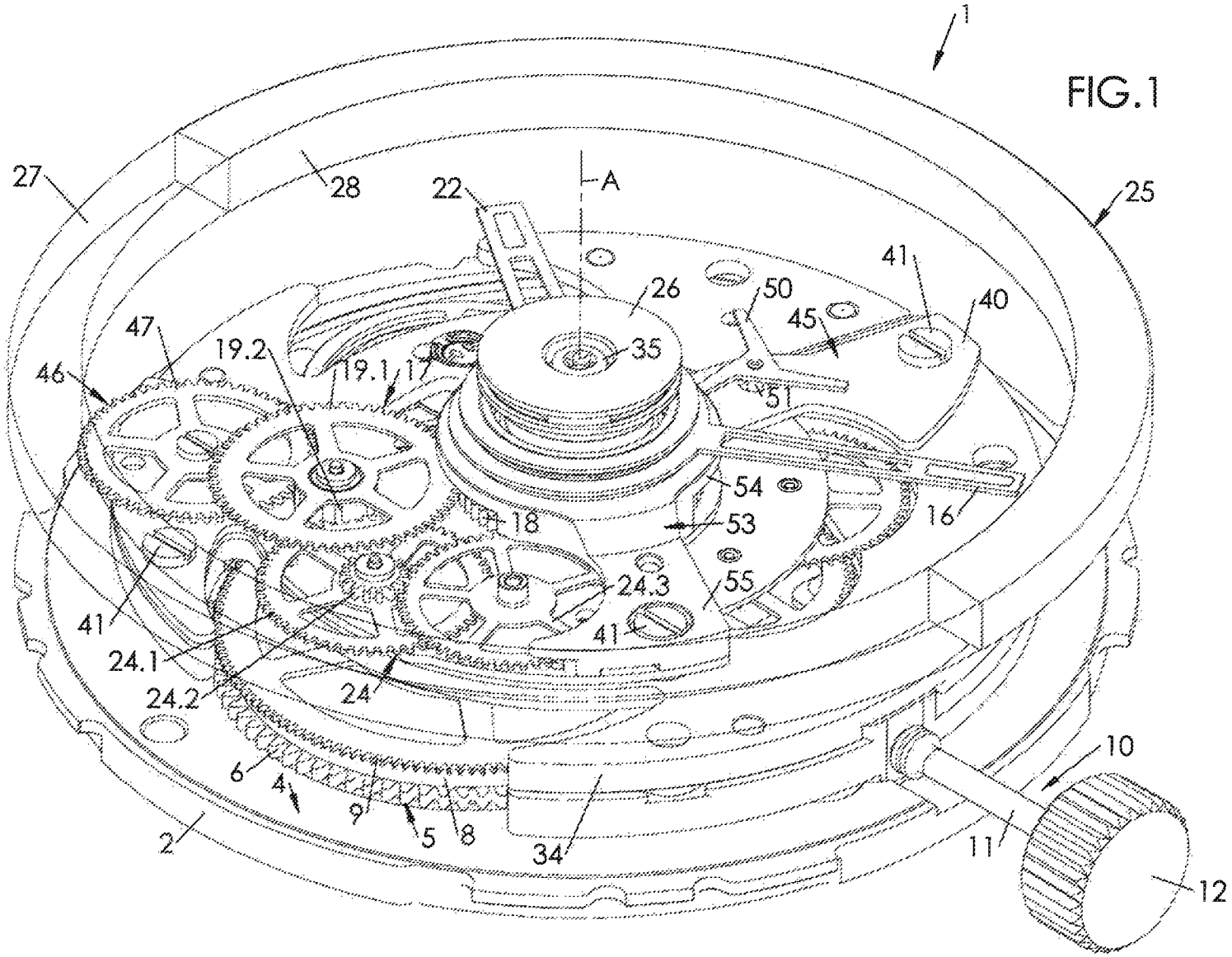
FIG. 1 is a perspective view of a horological mechanism with automatic winding, equipped with a rotor located on the same side as the display.

FIG. 1 shows a horological movement 1 with automatic winding. This movement 1 is intended to equip a wristwatch capable of being worn on the wrist.

The movement 1 firstly comprises a plate 2, which takes the form of a rigid part (preferably made of metal, for example steel), intended to form a support for various fixed or mobile components of the movement. The plate 2 has a bottom face 3 and a top face 4, opposite the bottom face 3.

The movement 1 secondly comprises a barrel 5 mounted such that it rotates relative to the plate 3 and provided with a primary toothed wheel 6. The barrel comprises a barrel-arbor 7 via which the barrel is mounted such that it rotates on the plate 2, a barrel-drum 8, and a mainspring (not shown) rigidly connected, by an inner end, to the barrel-arbor 7 and, by an outer end, to the barrel-drum 8.

Figure 6:
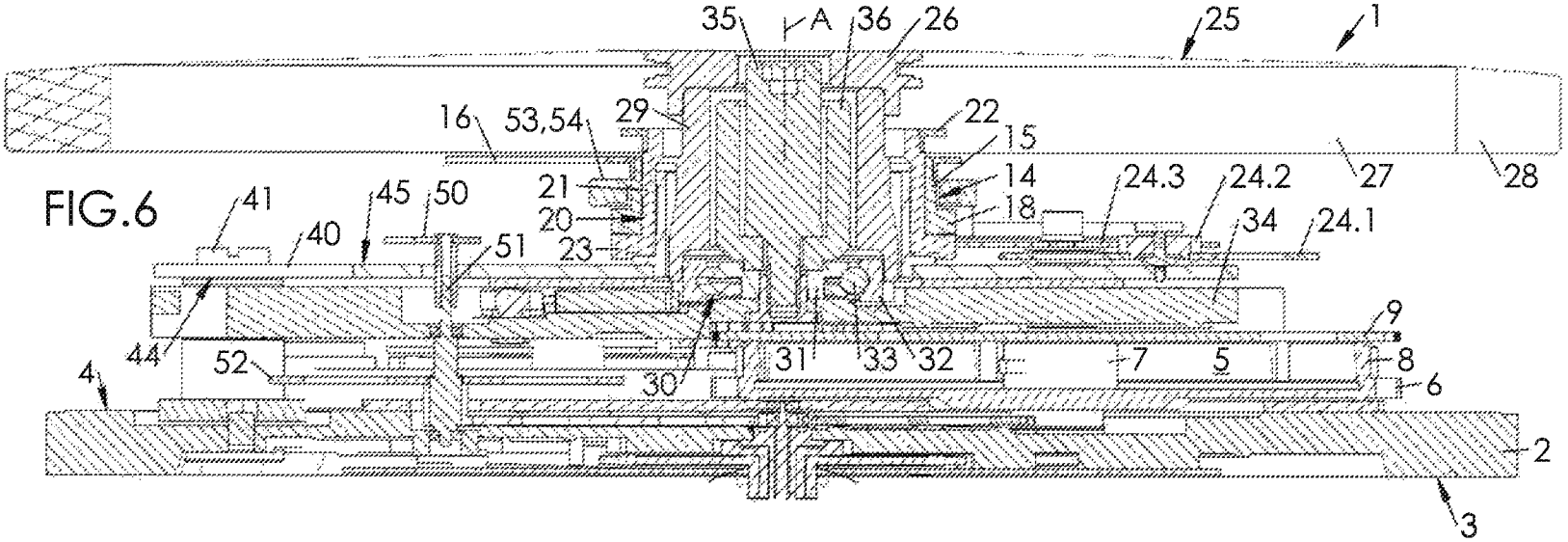
FIG. 6 is a sectional view of the mechanism in FIG. 4 along the cutting plane B-B.

As shown in particular in FIG. 6, the barrel is provided with a secondary toothed wheel 9 (also referred to as a "ratchet") that is separate from the primary toothed wheel 6.

The movement 1 thirdly comprises a winding unit 10 which comprises a winding stem 11 supporting, at an outer end, a winding button 12. The winding unit comprises a winding mechanism 13 via which the winding stem 11 meshes, in a winding position, with the secondary toothed wheel 9 of the barrel 5 in order to manually rotate and thus coil the spring.

The movement 1 fourthly comprises a cannon-pinion 14 mounted such that it rotates relative to the plate 2 about a central axis A. The cannon-pinion comprises a minute pipe 15 which supports a minute hand 16.

The cannon-pinion 14 meshes with the primary toothed wheel 6 of the barrel via a motion-work train 17.

Figure 7:
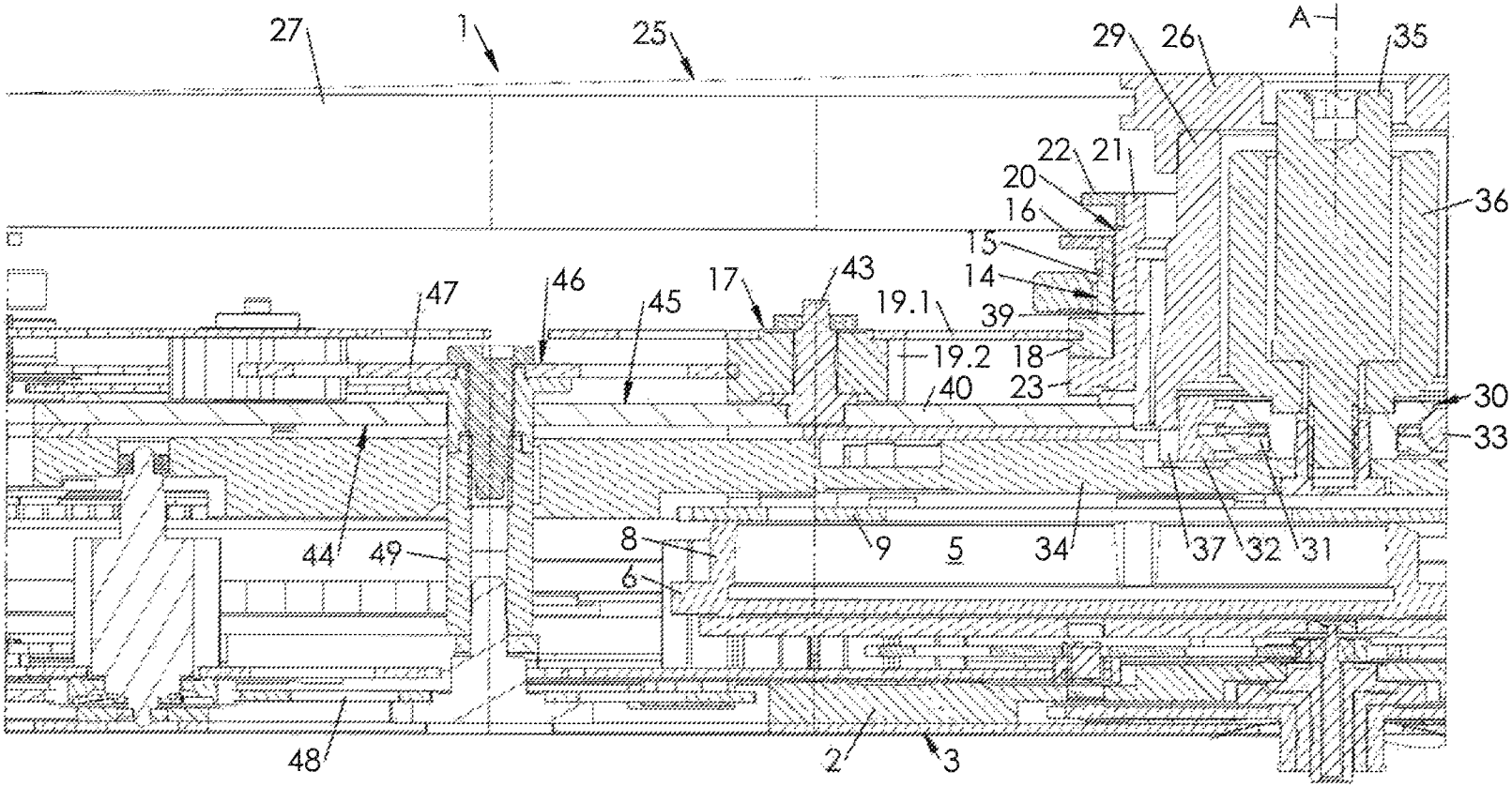
FIG. 7 is a partial sectional view of the mechanism in FIG. 4 along the cutting plane C-C.

More specifically, and according to one embodiment in particular shown in FIG. 7, the cannon-pinion 14 comprises a minute-pinion 18, rigidly connected to the minute pipe 15 (or formed in one piece therewith), and the motion-work train 17 comprises a minute-wheel 19.1 meshing with the minute-pinion.

The motion-work train 17 is mounted such that it rotates relative to the plate 2.

The movement 1 fifthly comprises an hour wheel set 20 mounted such that it rotates relative to the plate 2 about the central axis A. The hour wheel set comprises an hour pipe 21 which supports an hour hand 22.

The hour wheel set 20 meshes with the cannon-pinion 14. More specifically, and according to one embodiment shown in FIG. 7, the hour wheel set comprises an hour-pinion 23 rigidly connected to the hour pipe 21 (or made in one piece therewith), and the movement 1 comprises a gearing 24 that couples the hour wheel set in rotation with the cannon-pinion 14 in a gearing ratio R of 1/12.

More specifically, the gearing 24 comprises:

An hour wheel 24.1, which meshes with a motion-work pinion 19.2 rigidly connected to the minute-wheel 19.1 for rotation therewith;

A reduction-pinion 24.2 rigidly connected to the hour wheel 24.1 for rotation therewith;

A reverser wheel 24.3 inserted between the reduction-pinion 24.2 and the hour-pinion 23.

The following denotations are applied:

$N_M$ is the rotational speed of the minute-pinion 18 (and thus of the minute hand 16);

$N_H$ is the rotational speed of the hour-pinion 23 (and thus of the hour hand 22);

$Z_M$ is the number of teeth of the minute-pinion 18;

$Z_H$ is the number of teeth of the hour-pinion 23;

Z1 is the number of teeth of the minute-wheel 19.1;

Z2 is the number of teeth of the motion-work pinion 19.2;

Z3 is the number of teeth of the hour-wheel 24.1;

Z4 is the number of teeth of the reduction-pinion 24.2.

The gearing ratio R is written as follows:

$$R = \frac{N_H}{N_M} = \frac{Z_M \times Z2 \times Z4}{Z1 \times Z3 \times Z_H}$$

The gearings are chosen such that the gearing ratio R is equal to 1/12. The following example produces such a ratio R:

$$Z_M = Z_M = 64;\ Z1 = 60;\ Z2 = 16;\ Z3 = 48;\ Z4 = 15$$

The cannon-pinion 14, including the minute pipe 15 and the minute hand 16, is located on the same side of the plate 2 as the top face 4. Similarly, the hour wheel set 20, including the hour pipe 21 and the hour hand 22, is located on the same side of the plate 2 as the top face 4.

The movement 1 sixthly comprises an oscillating weight in the form of a rotor 25 mounted such that it rotates relative to the plate 2 about the central axis A, on the same side of the plate 2 as the cannon-pinion 14 and the hour wheel set 20—in this case on the same side of the plate as the top face 4.

Figure 5:
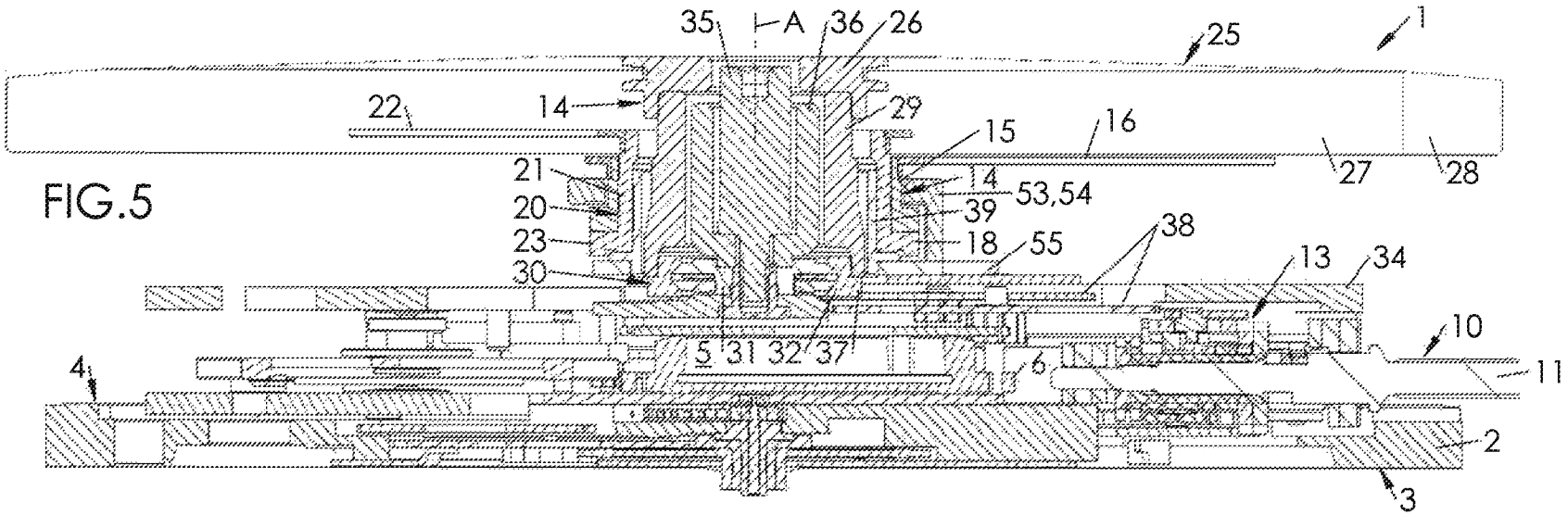
FIG. 5 is a sectional view of the mechanism in FIG. 4 along the cutting plane A-A.

As shown in particular in FIG. 5, the rotor 25 comprises:

A central hub 26 that meshes with the barrel 5;

A rim 27 rigidly connected to the central hub 26;

A heavy annular sector 28 which is rigidly connected to the rim 27.

According to one specific embodiment shown in the drawings, the rim 27 takes the form of a solid disc; however, it can be perforated. In the example embodiment, the rim is a solid disc made of a transparent material, for example made of industrial sapphire.

The heavy annular sector 28 takes, for example, the shape of a half-ring made of a material whose density is greater than that of the material of the rim 27. Thus, according to one specific embodiment, the heavy annular sector is made of brass.

The attachment of the heavy annular sector 28 to the rim 27 takes place, for example, by screwing, riveting, crimping or bonding.

The movement 1 seventhly comprises a lifting arbor 29 rigidly connected to the central hub 26 and via which it is mounted such that it rotates relative to the plate 2.

The lifting arbor 29 preferably takes the form of a hollow cylinder, for example made of steel.

The lifting arbor and the central hub could form a one-piece unit. However, in the example shown, the lifting arbor and the central hub form two separate parts attached to one another. According to one specific embodiment, the central hub is driven onto an upper end of the lifting arbor.

As shown in FIG. 5, the minute pipe 15 and the hour pipe 21 are mounted coaxially about the lifting arbor 29, the minute hand 16 and the hour hand 22 being located between the plate 2 and the rim 27 of the rotor.

Thus, while allowing the wearer to benefit from the display of the rotation of the rotor 25, this arrangement allows the hands 16, 22 to be positioned as close as possible to a potential dial or ring bearing hour graduations, thus improving the ease of reading the hours.

According to one preferred embodiment, the movement 1 comprises a bearing 30 provided with:

- A ring 31 that is fixed relative to the plate 2,
- A ring 32 that is capable of moving in rotation relative to the fixed ring 31 about the central axis A and to which the lifting arbor 29 is rigidly connected, and
- Rolling elements 33 inserted between the rings 31, 32 (generally balls).

The bearing 30 is advantageously mounted on an intermediate bar 34 attached to the plate 2.

In the example shown, the fixed ring 31 is an inner ring of the bearing 30, and the mobile ring 32 is an outer ring.

As shown in FIG. 5, FIG. 6 and FIG. 7, the inner ring 31 is secured to the intermediate bar 34 by a centre screw 35. In the example shown, an intermediate part 36 is inserted between the centre screw 35 and the inner ring 31 of the bearing 30. This intermediate part is fixed relative to the plate 2 and has two functions:

- To reinforce the lifting arbor in the event of lateral impacts to which the horological movement could be subjected,
- To absorb potential deformations caused by the clamping of the centre screw 35 on the inner ring 31, and thus to guarantee good coaxiality thereof with the central rotational axis A.

In the example shown, the lifting arbor 29 is driven on the mobile ring 32 located outside the bearing.

The mobile ring 32 preferably supports a toothed transmission wheel 37 that meshes with the barrel 5 via a reduction gear train 28 (shown in FIG. 5). More specifically, the reduction gear train meshes with the secondary toothed wheel 9 (train) of the barrel 5.

As shown in FIG. 5 and FIG. 6, the pipes 15, 21 freely surround the lifting arbor 29. For this purpose, the respective internal diameters of the pipes 15, 21 are greater than the external diameter of the lifting arbor, at least as regards the portion of this lifting arbor located inside the two pipes.

The movement 1 advantageously comprises a socket 39 surrounding the lifting arbor, this socket being fixed relative to the plate 2. The hour pipe 20 and the minute pipe 15 are mounted on the socket. In the example shown, the socket is rigidly connected (for example by being driven) to an upper bar 40 attached to the plate 2. More specifically, in the example shown, the upper bar is attached to the intermediate bar 34.

The inner ring 31 of the bearing 30 is attached to the intermediate bar by the centre screw 35, this centre screw further engaging, with this bar, the intermediate part 36, which has a bottom with a central hole for the passage of the centre screw and a rigid tube wherein the head of this centre screw is located, this rigid tube being located inside a central opening in the lifting arbor, this lifting arbor forming a rotating tube.

Figure 2:
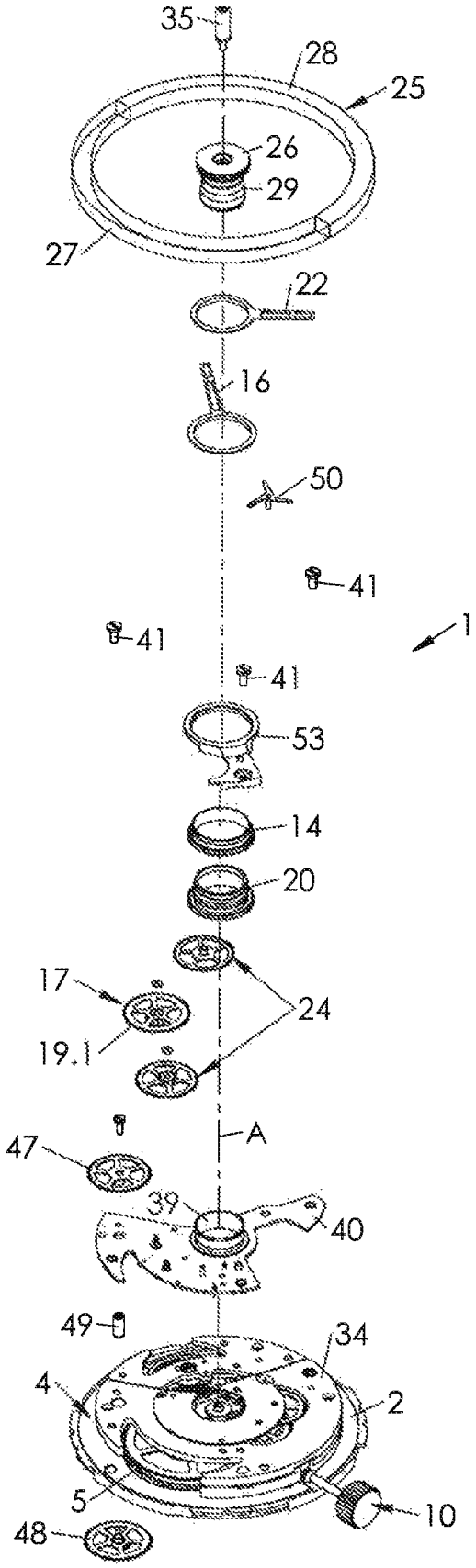
FIG. 2 is a perspective and exploded view of the mechanism in FIG. 1.
Figure 3:
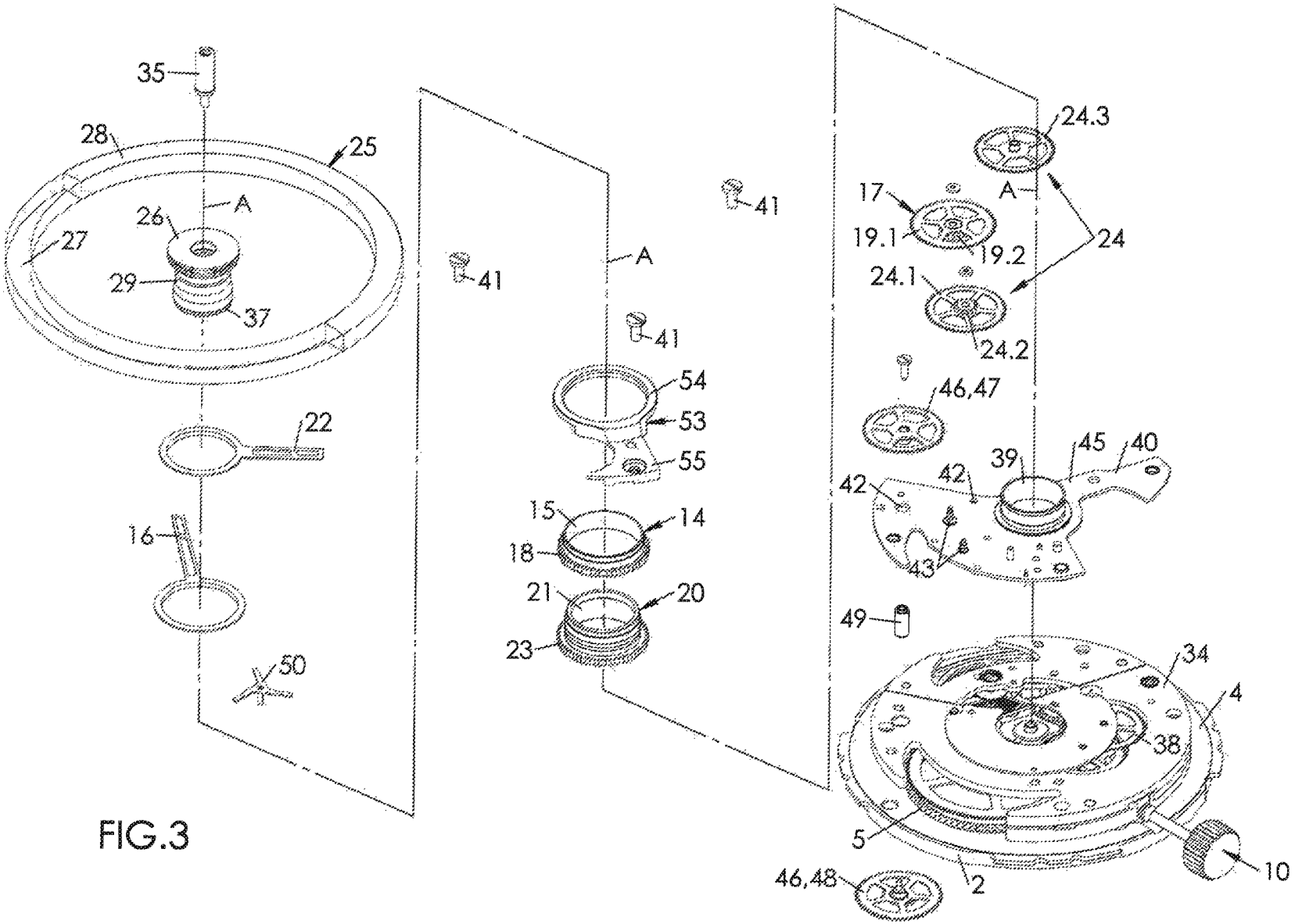
FIG. 3 is a similar view to that in FIG. 2, showing the mechanism on a larger scale.
Figure 4:
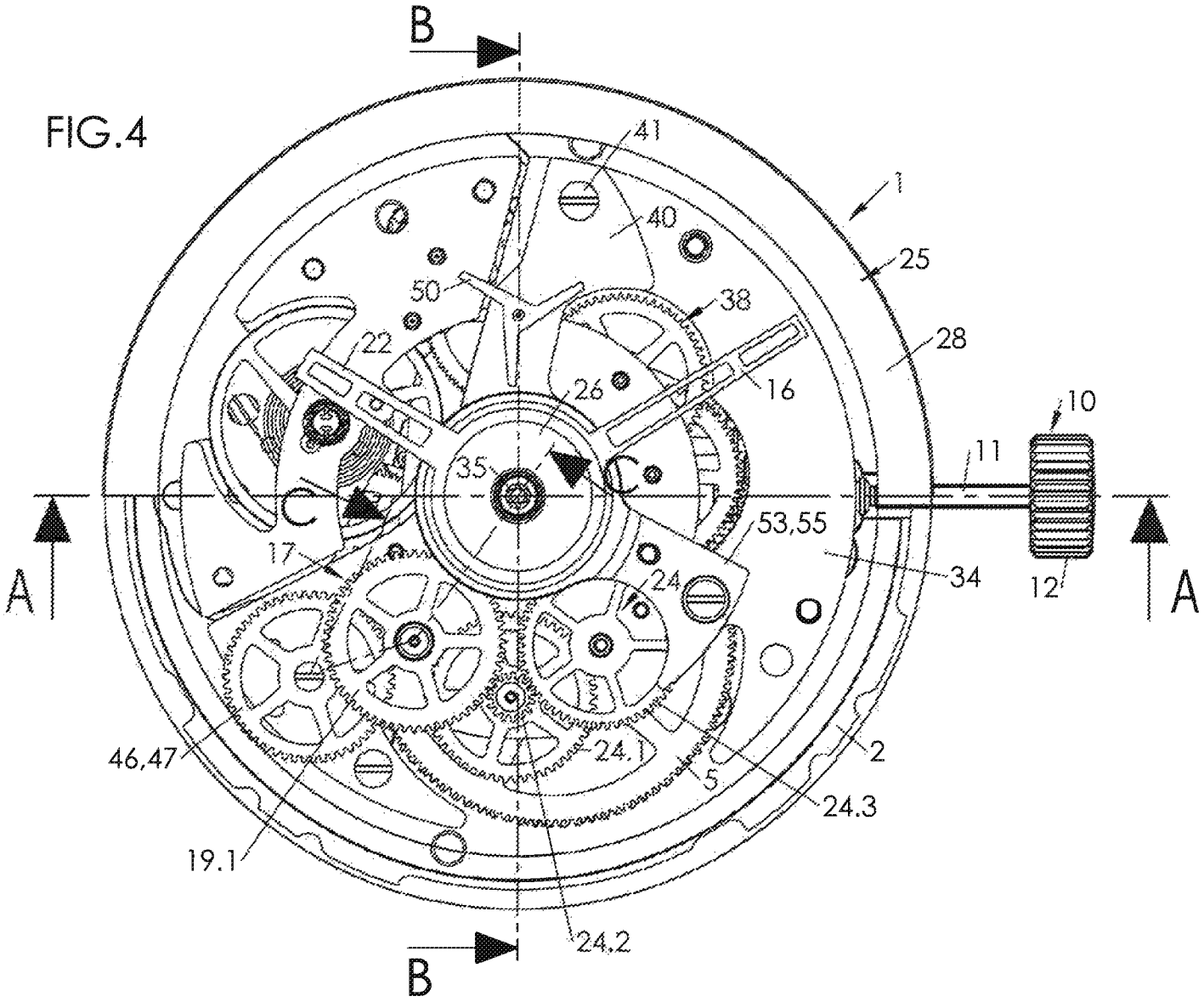
FIG. 4 is a plan view of the mechanism in FIG. 1.

The upper bar 40 is clearly shown in FIG. 2 and FIG. 3. The attachment of the upper bar to the intermediate bar 34 is, for example, carried out by means of screws 41, of which there are three in this case. As clearly shown in FIG. 3, the upper bar is pierced with holes 42 and bears shafts 43 for guiding the rotation of mobile parts of the movement 2, and in particular of components of the motion-work train 17.

According to one preferred embodiment:

The hour pipe 21 is slotted onto the socket 39,

The minute pipe 15 is slotted onto the hour pipe 21.

A first indenting is advantageously carried out at the interface between the socket 39 and the hour pipe 21 in order to allow the rotation thereof (with the hour hand 22) relative to the socket.

A second indenting is advantageously carried out at the interface between the hour pipe 21 and the minute pipe 15 in order to allow the rotation thereof (with the minute hand 16) relative to the hour pipe.

As shown in particular in FIG. 7, the barrel 5 is mounted on the same side of the upper bar 40 as an inner face 44 (facing the plate 2, and more specifically between the intermediate bar 34 and the plate 2), whereas the cannon-pinion 14, the hour wheel set 20 and the rotor 25 are mounted on the same side of the upper bar as an external face 45 (opposite the plate 2).

In order to ensure transmission of the rotation of the barrel 5 (located on the same side of the upper bar 40 as the inner face 44) to the motion-work train 17, the movement 1 is advantageously equipped with a reverser wheel set 46, which comprises:

- An upper wheel 47 located on the same side of the upper bar 40 as the external face 45 and meshing with the motion-work train 17 (and more specifically with the motion-work pinion 19.2);
- A lower wheel 48 located on the same side of the upper bar 40 as the internal face 44, rigidly connected to the upper wheel 47 for rotation therewith and meshing with the primary toothed wheel 6 of the barrel 5;
- A shaft 49 connecting, through the upper bar 40, the upper wheel 47 to the lower wheel 48.

According to one embodiment shown in FIG. 7, the shaft 49 passes not only through the upper bar 40 but also through the intermediate bar 34.

As shown in FIG. 7, the movement 1 can furthermore be equipped with a small seconds-hand 50, off-centre relative to the central axis A. The small seconds-hand is driven onto a shaft 51 rigidly connected to a seconds-wheel 52, meshing with the cannon-pinion 14 at a ratio of 1/60.

Moreover, as shown in particular in FIG. 1 and FIG. 2, the movement 1 comprises a bearing block 53 provided with a guide ring 54 which surrounds the cannon-pinion 14, and a steady pin 55 via which the bearing block 53 is attached to the upper bar 40.

The movement described hereinabove in particular procures the advantages stipulated hereafter.

Firstly, the fact that the rotor 25 is located on the same side as the time display (i.e. as the hands 15, 22) allows the wearer to benefit from the display offered by the movement of the rotor, which is not compatible with an arrangement thereof opposite the display.

Secondly, unlike with the majority of movements of this type, the fact that the rotor 25 is positioned above the hands 15, 22 (which is in particular made possible by the presence of the lifting arbor) allows them to be positioned as close as possible to the body of the movement and to a graduation of the hours that can be located on the rear face of this body, thus improving the ease of reading the display.

Finally, it should be noted that the horological movement that has just been described can easily further comprise an additional time display located on the front face side of the plate 2. In the latter case, a dual time display is obtained, whereby the second display can correspond, for example, to a different time zone to that of the first display.

The invention claimed is:

1. A horological movement with automatic winding, which comprises:

a plate, a barrel mounted such that it rotates relative to the plate and supporting a primary toothed wheel, a cannon-pinion mounted such that it rotates relative to the plate about a central axis and meshing with the primary toothed wheel of the barrel by way of a motion-work train, said cannon-pinion comprising a minute pipe which supports a minute hand, an hour wheel set mounted such that it rotates relative to the plate about said central axis and meshing with the cannon-pinion, said hour wheel set comprising an hour pipe which supports an hour hand, an oscillating weight in the form of a rotor mounted such that it rotates relative to the plate about the central axis, on the same side of the plate as the cannon-pinion and the hour wheel set, said rotor comprising:

a central hub that meshes with the barrel, a rim rigidly connected to the central hub, a heavy annular sector which is rigidly connected to the rim;

wherein said horological movement comprises a lifting arbor rigidly connected to the central hub and via which this hub is mounted such that it rotates relative to the plate; and wherein the minute pipe and the hour pipe are mounted coaxially about the lifting arbor that passes therethrough, the minute hand and the hour hand being located between the plate and the rim of the rotor.

2. The horological movement according to claim 1, comprises a bearing provided with a ring that is fixed relative to the plate, a ring that is capable of moving in rotation relative to the fixed ring about the central axis, and rolling elements inserted between the two rings; and wherein the lifting arbor is rigidly connected to the mobile ring.

3. The horological movement according to claim 2, wherein the ring capable of moving in rotation supports a toothed transmission wheel that meshes with the barrel via a reduction gear train.

4. The horological movement according to claim 3, wherein the barrel supports a secondary toothed wheel that is separate from the primary toothed wheel and with which the reduction gear train meshes.

5. The horological movement according to claim 2, wherein the bearing is mounted on a bar attached to the plate.

6. The horological movement according to claim 2, wherein the fixed ring is an inner ring and the ring capable of moving in rotation is an outer ring.

7. The horological movement according to claim 6, wherein the bearing is mounted on a bar attached to the plate; and wherein the inner ring of the bearing is attached to the bar by a centre screw, this centre screw further engaging, with this bar, an intermediate part, which has a bottom with a central hole for the passage of the centre screw and a rigid tube wherein the head of this centre screw is located, said rigid tube being located inside a central opening in the lifting arbor, said lifting arbor forming a rotating tube.

8. The horological movement according to claim 1, comprises a socket that is fixed relative to the plate and on which the hour pipe and the minute pipe are mounted, said fixed socket surrounding the lifting arbor.

9. The horological movement according to claim 8, comprising:

the hour pipe is slotted onto the socket, the minute pipe is slotted onto the hour pipe.

10. The horological movement according to claim 8, wherein the socket is mounted, such that it is fixed, on an upper bar, which is attached to the plate, said upper bar having an internal face on the same side as the plate, and an opposite external face.

11. The horological movement according to claim 10, wherein the barrel is mounted on the same side of the upper bar as the internal face, whereas the cannon-pinion, the hour wheel set and the rotor are mounted on the same side of said upper bar as the external face.

12. The horological movement according to claim 11, comprising:

a motion-work train meshing with a minute-pinion rigidly connected to the minute pipe, which motion-work train is mounted such that it rotates relative to the upper bar on the same side thereof as the external face, a reverser wheel set, which comprises:

an upper wheel located on the same side of the upper bar as the external face and meshing with the motion-work train, a lower wheel located on the same side of the upper bar as the internal face and rigidly connected to the upper wheel for rotation therewith and meshing with the primary toothed wheel of the barrel, a shaft connecting, through the upper bar, the upper wheel to the lower wheel.

* * * * *